United States Patent [19]

Takeuchi et al.

[11] 4,216,271

[45] Aug. 5, 1980

[54] COMPOSITE DIAPHRAGM FOR SPEAKER

[75] Inventors: Hiroshi Takeuchi, Matsubara; Hideaki Inoue, Neyagawa; Hidetsugu Kawabata, Hirakata; Keizo Ishiwatari, Kobe, all of Japan

[73] Assignee: Matsushita Electric Industrial Co., Ltd., Osaka, Japan

[21] Appl. No.: 848,316

[22] Filed: Nov. 3, 1977

[30] Foreign Application Priority Data

Nov. 5, 1976 [JP] Japan ..... 51-133380

[51] Int. Cl.[2] ..... H04R 7/12

[52] U.S. Cl. ..... 428/607; 181/168; 181/170; 428/615; 428/621; 428/627; 428/649; 428/650; 428/651; 428/660

[58] Field of Search ..... 181/168, 170; 428/607, 428/621, 627, 628, 650, 651, 660, 649, 615

[56] References Cited

U.S. PATENT DOCUMENTS

| | | | |
|---|---|---|---|
| 3,936,277 | 2/1976 | Jakway | 428/621 X |
| 4,135,601 | 1/1979 | Tsukagoshi et al. | 181/170 X |
| 4,153,483 | 5/1979 | Holzl | 428/660 X |

FOREIGN PATENT DOCUMENTS

| | | | |
|---|---|---|---|
| 2757707 | 6/1978 | Fed. Rep. of Germany | 181/168 |
| 53-4421 | of 1978 | Japan | 181/168 |
| 53-45135 | of 1978 | Japan | 181/168 |
| 53-45136 | of 1978 | Japan | 181/168 |

OTHER PUBLICATIONS

Ishiwatari et al., "The Boron Dome Diaphragm for Loud-Speakers", Audio Eng. Soc. Preprint, 1976.

*Primary Examiner*—Richard E. Schafer
*Attorney, Agent, or Firm*—Stevens, Davis, Miller & Mosher

[57] ABSTRACT

A composite diaphragm for a speaker comprises a boron layer formed on a metal foil such as titanium foil, in which a layer of a low melting point metal such as aluminum or magnesium is interposed between the metal foil and the boron layer to provide high rigidity, high elasticity and high bonding strength between the metal foil and the boron layer.

3 Claims, 3 Drawing Figures

COMPOSITE DIAPHRAGM FOR SPEAKER

BACKGROUND OF THE INVENTION

1. Field of the Invention

The present invention relates to a composite diaphragm for a speaker having a boron layer formed on a surface of a titanium foil, and more particularly to a composite diaphragm for a speaker which significantly increases bonding strength between the titanium foil and the boron layer.

2. Description of the Prior Art

The requirements for a good diaphragm material generally include light weight, high rigidity, high elasticity, high workability and appropriate internal loss and damping factor. Since those requirements compete with each other, it is almost impossible to meet all of the requirements with a known material. In one proposed approach, the diaphragm is made by forming titanium (Ti) foil, which is relatively light and has relatively high elasticity and good workability, into a shape of diaphragm and forming on the surface thereof a boron (B) layer, which is light and has very high elasticity by P.V.D. (physical vapor deposition) technique or C.V.D. (chemical vapor deposition) technique so that the resulting diaphragm has both mechanical property of titanium and high elasticity of boron. However, since the solid solubility between titanium and boron is so low that diffusion layer is hardly formed at the interface, the resulting diaphragm cannot be practically used because of poor bonding between the titanium foil and the boron layer. To resolve the above problem, the following treatments (1) to (3) have been adopted to enhance the bonding strength, but with each it remains difficult to attain satisfactory bonding.

(1) Treatment for cleaning the surface of the titanium foil.

(2) Heat treatment of the titanium foil during the formation of the boron layer.

(3) Heat treatment for forming a diffusion layer of the titanium foil and the boron layer.

SUMMARY OF THE INVENTION

It is an object of the present invention to provide a composite diaphragm for a speaker which assures good bonding without requiring the treatments (1) to (3) described above.

DESCRIPTION OF THE PREFERRED EMBODIMENTS

Figure 1:
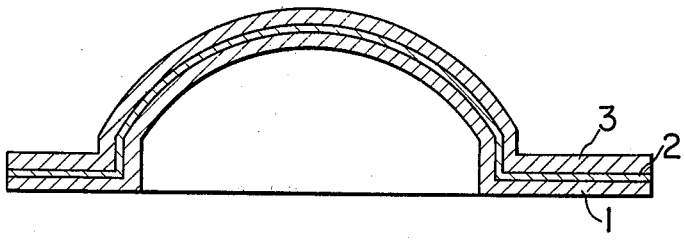
FIG. 1 shows a sectional view of a composite diaphragm for a speaker in accordance with one embodiment of the present invention.

Referring to FIG. 1, a basic construction of the present invention will be explained.

In FIG. 1, numeral 1 denotes a titanium foil formed into a shape of a diaphragm, 2 dentoes a layer of a low melting point metal and 3 denotes a boron layer.

An example in which aluminum (Al) is used as the low melting point metal layer 2 is now explained. When the aluminum layer 2 is interposed between the titanium foil 1 and the boron layer 3, the titanium foil-boron layer interfaces are titanium-aluminum and aluminum-boron. The solid solubility of boron into titanium at the titanium-boron interface is 0.05% by weight at 750°-1300° C. and 1% by weight at 1670° C. while the solid solubility of boron into aluminum at the aluminum-boron interface is 0.17% by weight at 785° C. and 0.09% by weight at 730° C. Accordingly, by forming the aluminum layer, more boron can be solid-dissolved at lower temperature than at the titanium-boron interface, and hence the bonding strength can be enhanced. Furthermore, experiments have shown that the bonding strength at the titanium-aluminum interface is sufficiently high to compare with that at the aluminum-boron interface. Further, by heating the titanium foil to 400°-600° C. when the aluminum layer and the boron layer are formed the high bonding strength can be obtained in a stable manner.

Examples of the present invention will now be explained. For each example, the bonding strength was compared between a diaphragm with the low melting point metal layer such as an aluminum layer and one without such layer. In each case, it was shown that the one with the low melting point metal layer was excellent and the use of the low melting point metal layer provided diaphragm material which had sufficient bonding strength for practical use.

EXAMPLE 1

A titanium foil having a thickness of 20$\mu$ was formed, and an aluminum layer having a thickness of approximately 1$\mu$ was deposited by a vacuum vapor deposition technique on a sample which had been etched by dilute fluoric acid solution for several minutes. Thereafter, a boron layer having a thickness of 10$\mu$ was formed by electric field vapor deposition.

EXAMPLE 2

In the Example 1, the titanium foil was heated to 600° C. during the formation of the boron layer.

EXAMPLE 3

The aluminum layer and the boron layer were formed on the titanium foil in the same manner as the Example 1. Thereafter, the foil was heated to 600° C. for 1 hour in an argon (Ar) atmosphere. The sample without the aluminum layer was heated to 850° C. for 3 hours.

While the above examples used aluminum as the low melting point metal, magnesium may be used instead of aluminum, and aluminum foil may be used instead of the titanium foil.

The bonding strength between the titanium foil and the boron layer of the diaphragm of each of the Examples 1 to 3 was 220-230 kg/cm$^2$, which was more than 4 to 5 times as high as that of the one without the aluminum layer.

Figure 2A:
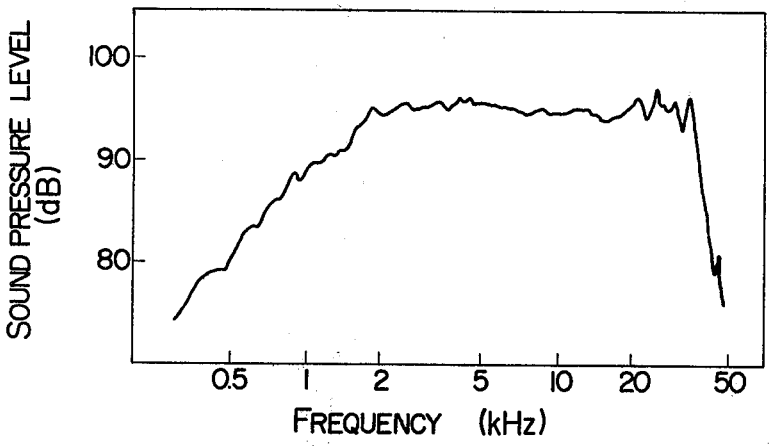
FIGS. 2(*a*) and 2(*b*) show sound pressure-frequency characteristics of a speaker.
Figure 2B:
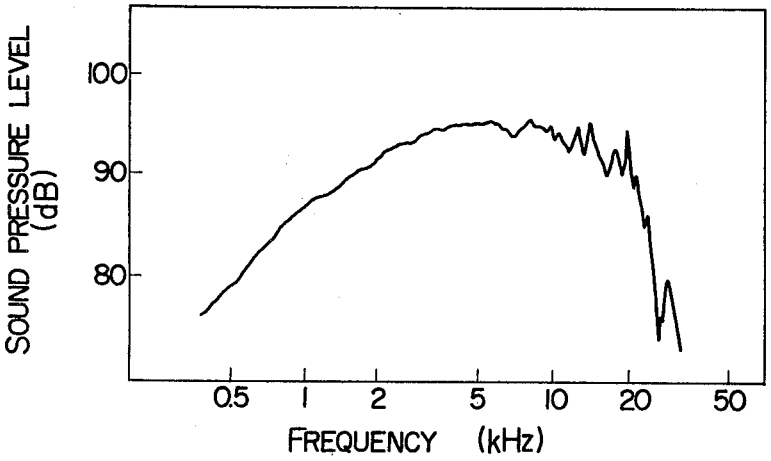

FIG. 2(*a*) shows a sound pressure to frequency characteristic of a speaker which incorporates the composite diaphragm of the Example 1 and FIG. 2(*b*) shows a sound pressure to frequency characteristic of a speaker incorporating a diaphragm solely comprising the titanium foil. It is apparent that the boron layer in accordance with the present invention expands the high frequency limit and provides a flat sound pressure to frequency characteristic.

As shown in the Examples, the present invention is characterized by the provision of the low melting point metal layer such as aluminum layer between the titanium foil and the boron layer. According to the present invention, the bonding strength between the titanium foil and the boron layer is materially increased.

What is claimed is:

1. A composite diaphragm for a speaker comprising:

a metal foil;

a first vapor deposition layer of a material selected from a group consisting of aluminum and magnesium, formed on a surface of said metal foil, said material being different from said metal foil; and a boron second vapor deposition layer formed on said first vapor deposition layer.

2. A composite diaphragm for a speaker according to claim 1 wherein said metal foil is a titanium foil.

3. A composite diaphragm for a speaker according to claim 1 wherein said metal foil is an aluminum foil.

* * * * *